US006045264A

United States Patent [19]

Miniea

[11] Patent Number: 6,045,264

[45] Date of Patent: Apr. 4, 2000

[54] SELF-SEALING, DISPOSABLE STORAGE BAG

[76] Inventor: Stephen H. Miniea, 12355 SW. 132nd Ct., Miami, Fla. 33186

[21] Appl. No.: 09/015,131

[22] Filed: Jan. 29, 1998

[51] Int. Cl.[7] ..... B65D 33/16

[52] U.S. Cl. ..... 383/41; 383/33; 383/44; 383/59; 383/63; 383/100

[58] Field of Search ..... 383/41, 44, 63, 383/59, 100, 61, 101, 102, 33; 206/524.8

[56] References Cited

U.S. PATENT DOCUMENTS

| | | | |
|---|---|---|---|
| 3,357,632 | 12/1967 | Stanforth | 383/44 |
| 4,849,491 | 7/1989 | Ogawa et al. | 528/15 |
| 4,892,414 | 1/1990 | Ausnit | 383/63 |
| 4,903,718 | 2/1990 | Sullivan | 383/63 X |
| 5,142,970 | 9/1992 | ErkenBrack | 383/63 X |
| 5,261,532 | 11/1993 | Fauci | 383/38 X |
| 5,293,672 | 3/1994 | Tominaga et al. | 383/63 X |
| 5,380,093 | 1/1995 | Goldman | 383/100 X |
| 5,511,884 | 4/1996 | Bruno et al. | 383/100 X |
| 5,544,752 | 8/1996 | Cox | 383/100 X |
| 5,839,582 | 11/1998 | Strong et al. | 383/63 X |

FOREIGN PATENT DOCUMENTS

| | | | |
|---|---|---|---|
| 1247945 | 10/1960 | France | 383/63 |
| 1338549 | 8/1963 | France | 383/44 |
| 1112446 | 8/1961 | Germany | 383/63 |
| 212355 | 9/1991 | Japan | 383/61 |

*Primary Examiner*—Jes F. Pascua
*Attorney, Agent, or Firm*—David P. Lhota, Esq.; Bowen & Lhota, P.A.

[57] ABSTRACT

A self-sealing disposable storage bag for storing perishable foods or biohazardous waste wherein the storage bag comprises a pouch having a self-sealing interlocking system extending longitudinally across, near an open top end, the open top end having a main opening contiguous with an evacuation opening, each opening having a separate and independent cooperative pairs of interlocking strips to make up the interlocking system. The interlocking system also includes a pliable gasket seal and a defined groove of predetermined interlocking strips for providing a true airtight seal when the main and evacuation openings are closed. A tapered barrier as defined above the evacuation opening for providing a corridor that receives a suction conduit having a corresponding tapered flange end which engages the tapered barrier and facilitates the evacuation of air from the storage bag when the main opening is closed. The storage bag may also include just a main opening when the main opening includes cooperative interlocking strips, at least one of which has a pliable gasket providing a true airtight seal.

8 Claims, 4 Drawing Sheets

SELF-SEALING, DISPOSABLE STORAGE BAG

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to disposable, flexible, self-sealing storage bags and, more particularly, to an improved interlocking feature for disposable, self-sealing storage bags that facilitates the convenient evacuation of air therefrom, capable of creating a vacuum therein, and/or the maintenance of a true, airtight seal to keep air from leaving or entering the bag. The invention further relates to the manufacturing process for the inventive storage bag.

2. Description of Related Art

Self-sealing, disposable, plastic film bags are well known in the prior art. Self-sealing bags are flexible and disposable and incorporate interlocking strips which extend across the entire open end of the bag. The interlocking strips include mateable male and female, or tongue and groove portions which interlock to close the open end of the bag. Conventional interlocking bags include those sold under the trademark Ziplock®. Once contents are placed in the storage bag, the male and female strips are oriented, engaged, and pressed shut by applying continuous compression across the strips with the fingers or a slide mechanism. Conventional self-sealing bags, however, are not designed for conveniently evacuating air from the bag or for maintaining an airtight seal.

Self-sealing bags are primarily purchased in the consumer market for storing perishable foods. The bags are used to temporarily store food, such as leftovers or sandwiches, or to place food, such as meats, in the freezer over a long period of time. Despite the convenience and success of self-sealing bags, food can still go stale or suffer freezer burn. This is because conventional self-sealing storage bags do not offer structure for evacuating air or making a true airtight seal. To evacuate air from inside the bag, users try to keep a segment of the bag open while pressing down on the bag to force air out. This process fails to remove all the air and is a crude, inconvenient way to evacuate air. The conventional self-sealing bags also fail to provide true airtight seals. This is because they do not have structure, such as rubber gaskets, for preventing air from passing between the interlocking portions. Tests have been conducted which show that a self-sealing bag that is filled with air will deflate over a period of time. Likewise, air can enter the bag between the interlocking portions. Since air cannot be kept out of the bag or evacuated, frozen food experiences freezer burn and non-frozen food becomes stale. If self-sealing bags were constructed in a way that facilitated the evacuation of air and/or the creation of a truly airtight seal, such a bag would keep food fresh indefinitely and would be well received.

Self-sealing bags could also be used for storing and discarding biohazardous waste in the medical and dental fields if an airtight seal was achievable. Biohazardous waste includes tissue specimens, intravenous bags, rubber gloves, urine samples, laboratory rats, and other medical trash.

Biohazardous waste comprises any solid or liquid product that could potentially transmit airborne illnesses, communicable illnesses, and infections to the public. The proper disposal of biohazardous waste has become increasingly important, especially in light of diseases, like AIDS, and problems with medical waste washing up on beaches in Florida, New Jersey, New York, and Connecticut. In fact, medical waste has historically been deposited in regular trash receptacles that are directly exposed to ambient. Because of the inherent, obvious dangers of biohazardous waste emissions and the ongoing, improper handling of said waste, the Environmental Protection Agency (EPA) is requiring all companies that handle medical waste to install equipment to cut down on dangerous emissions. An airtight, self-sealing, disposable bag would provide a simple, inexpensive solution for preventing the dangerous emission of biohazardous waste prior to its delivery to incinerators.

Several attempts have been made in the prior art to provide flexible, disposable, self-sealing bags which are capable of having air evacuated therefrom. However, none of these references has addressed or adequately solved the above-noted issues. One of the main problems associated with providing an airtight, self-sealing bag that evacuates air relates to manufacturing. That is, current flexible plastic bags are extruded at a high rate of speed, making it difficult, if not impossible, to alter the structure of the bag without affecting production. The prior art has failed to proffer a flexible bag that can be easily adapted to existing manufacturing machinery and procedures.

Known evacuation assemblies comprise separate structures which must be molded into the bag or include permanent conduit structures. Existing self-sealing bags further have failed to provide any gasket structure for effectuating a true, airtight seal. For instance, U.S. Pat. No. 5,240,112, issued to Neuberger, comprises a thin, flexible plastic bag having a conventional main zipper closure at its upper end and a stem with a pinched valve protruding outward from the lower end. U.S. Pat. No. 5,544,752, issued to Cox, teaches an evacuable storage bag that includes a permanent, exterior suction conduit that is designed to break off after use and has cooperative sealing strips therein for sealing the conduit once air has been evacuated. The '112 and '752 Patents cannot be adapted to existing extrusion manufacturing techniques, do not teach an evacuation opening that is contiguous with the main opening, and cannot hold an airtight seal. U.S. Pat. No. 4,923,701, issued to Van Erden, comprises a zippered cook-in-the-bag pouch which is designed to withstand, without deterioration, maximum cooking heat. The '701 Patent does not address or teach the evacuation of air or a self-sealing strip that provides a true airtight seal. U.S. Pat. No. 3,980,226, issued to Franz, comprises an evacuable bag having a permanently affixed evacuating tube with a threaded cap and an open end which is tied shut. The '226 Patent does not provide a true airtight seal and is incompatible for existing extrusion manufacturing. U.S. Pat. No. 5,142,970, issued to Erkenbrack, comprises an apparatus for storing matter out of contact with gas and is not pertinent to the particular problems discussed herein. The '970 Patent is not adaptable to existing extrusion manufacturing and does not provide a true airtight seal. U.S. Pat. No. 5,339,959, issued to Cornwell, discloses a disposable medical waste bag having an open top end which is twisted shut and a valve for connecting a vacuum. The '959 Patent is not self-sealing and does not provide an airtight seal. U.S. Pat. No. 5,494,165, issued to Detrick, comprises a rigid container for holding articles to be vacuum-packed comprising an open end, a lid which makes airtight engagement with the open end, and a tube that projects through the lid in an airtight fit and communicates with the interior of the container for evacuating air. The '165 Patent does not contemplate a self-sealing, flexible, disposable bag.

The foregoing devices fail to teach a self-sealing, disposable, flexible bag capable of having air evacuated therefrom, and providing a true airtight seal for keeping air from entering or exiting the bag. As the prior art fails to teach an evacuable and/or an airtight bag for keeping food fresh in one use, or for retaining biohazardous waste in an airtight, disposable package in another use, there exists a need for a self-sealing, disposable storage bag that is capable of evacuating air and/or maintaining a true airtight seal.

BRIEF SUMMARY OF THE INVENTION

Based on the foregoing, it is an object of the present invention to provide a self-sealing, disposable storage bag designed for evacuating air from the bag to create a vacuum therein.

It is another object of the present invention to provide a self-sealing, disposable storage bag designed for holding a vacuum.

It is an additional object of the instant invention to provide a self-sealing, disposable storage bag that achieves a true, airtight seal.

It is a further object of the instant invention to provide a self-sealing, disposable storage bag that is convenient and inexpensive to manufacture.

It is still another object of the instant invention to provide a self-sealing, disposable storage bag for storing food and preventing spoilage thereof or freezer burn thereto.

It is still an additional object of the instant invention to provide a self-sealing, disposable storage bag that safely stores biohazardous waste, preventing dangerous emissions.

It is still a further object of the instant invention to provide a self-sealing, disposable storage bag that may be puncture-resistant.

It is yet another object of the instant invention to provide a self-sealing, disposable storage bag that utilizes a section of a conventional storage bag's original opening to create an evacuation opening.

It is yet an additional object of the instant invention to provide a self-sealing, disposable storage bag having a main opening and an evacuation opening contiguous with the main opening for drawing a vacuum therefrom when the main opening is closed.

It is yet a further object of the instant invention to provide a self-sealing, disposable storage bag having a self-sealing, interlocking strip system partitioned to define an evacuation opening having a self-sealing, interlocking strip system therein which is operatively independent from the interlocking strip system in the main opening.

It is yet a further object of the instant invention to provide a self-sealing, disposable storage bag having an evacuation opening adapted for mechanically cooperating with an external device that removes air from the storage bag.

A further object of the instant invention is to provide a self-sealing, disposable storage bag having a main opening, an evacuation opening, and independent, albeit contiguous, self-sealing, interlocking strips retrofitted with a pliable gasket for creating a true airtight seal.

Another object of the instant invention is to provide a self-sealing, disposable storage bag that incorporates a pliable gasket that is non-toxic, flexible, and safe.

In light of these and other objects, the instant invention comprises a self-sealing, disposable storage bag that may be evacuated and/or provide a true airtight seal. The storage bag is made from a flexible plastic film material, such as polyethylene, that may also be puncture-resistant. The storage bag comprises several embodiments that enable a user to evacuate air captured therein after closing the bag shut to insure the freshness of the product therein. The invention may also incorporate a gasket seal, such as a pliable gum or silicone-type substance, that forms to and seals the interlocking structure. This prevents air from entering or leaving the bag. Consequently, the instant invention may also be used for storing and discarding biohazardous waste.

The instant invention includes self-sealing, cooperative interlocking strips extending across opposing surfaces of the bag, proximal the bag's opening. The interlocking system preferably comprises opposing tongue and groove strips as is known in the art, or tongue and groove strips that comprise new and unobvious structure. The interlocking strips include at least one barrier dividing the interlocking system into two distinct sections. One section defines a main opening, and the second section defines an evacuation opening. When the main opening is pressed shut, the evacuation opening remains open for forcing or drawing air out from the bag. Once air has been exhausted, or a vacuum created, the evacuation opening is designed to be pinched shut almost simultaneously. At least one of the interlocking strips may include at least one pliable gasket that is positioned in a defined groove in at least one strip for completely sealing the bag shut when the opposing strips interlock.

The evacuation opening is further defined by tapered barriers which may or may not be a continuation of the barrier defining the evacuation opening. The tapered barrier is preferably positioned above the evacuation opening and designed to snugly receive a suction conduit means having a corresponding tapered, flanged end. The suction conduit may comprise a straw having a flanged lower end that mates with the tapered barrier so the straw is not inadvertently and prematurely pulled from the bag before air has been withdrawn from the bag. Once the main opening is sealed shut, the suction conduit, or straw, is pulled up until its tapered end mates with the tapered barrier. This allows air to be evacuated without interfering with the interlocking strips in the evacuation opening so that the opening may be pinched shut without letting air back into the bag. The tapered barrier may comprise different embodiments that accommodate corresponding conduits or straws, allows a conduit to be reinserted, or cooperates with an external vacuum device. The barrier may also be designed to receive a separating strip or stick that keeps the evacuation opening open while the main opening is sealed or pressed shut.

In an alternative embodiment, the instant invention may comprise a self-sealing, disposable bag having at least one continuous self-sealing, cooperative, interlocking strip system with a gasket sealant positioned in a defined groove therein. This design can be used for storing food and evacuating air as previously known. The design is also usable for storing biohazardous waste, where the object is to lock air in the bag to prevent harmful emissions. A second pair of self-sealing, interlocking strips may be positioned in parallel alignment with the first interlocking sealing strips. The second interlocking system may or may not include a gasket sealant. At least one of the interlocking systems preferably includes a gasket sealant.

In another embodiment, the instant invention may also include an adhesive seal. An adhesive seal is designed to prevent the reopening of the bag.

The instant invention also includes a novel, non-obvious manufacturing process that is designed to be easily adapted into existing manufacturing machinery and techniques. Conventional manufacturing techniques extrude sheets of plastic film that are folded and heat-sealed along two edges to define an open end. The open end includes the interlocking strips which are formed and/or placed as the plastic sheet is extruded. The instant invention incorporates novel steps to achieve the structure of the instant invention. In those embodiments employing an interlocking strip system barrier, that is, the barrier which defines the evacuation opening, the step of making the barrier is added. On the assembly line, once the interlocking strips have been formed and the sheet has been folded, a heat-sealant probe, gun, needle, press, roller, or other known substitute, heat-seals the strip barrier by heat-sealing a segment of the strips together so that two distinct, continuous, interlocking strip systems are formed. An additional, albeit similar, step forms the tapered barriers, simultaneously or not simultaneously. In those embodiments employing a gasket sealant, a needle, probe, spray nozzle, or similar known object injects the gasket material into at least one interlocking strip. The gasket is injected at a high speed and maintains the gasket at a soft, fluid state so that it levels out before curing. The gasket has a known consistency and viscosity and may include a catalyst that dictates the curing time as well as heat. Alternatively, the gasket may be pre-extruded into rolls and pressed, sprayed, or laid into the corresponding interlocking strip.

In accordance with these and other objects which will become apparent hereinafter, the instant invention will now be described with particular reference to the accompanying drawings.

DETAILED DESCRIPTION OF THE INVENTION

Figure 1:
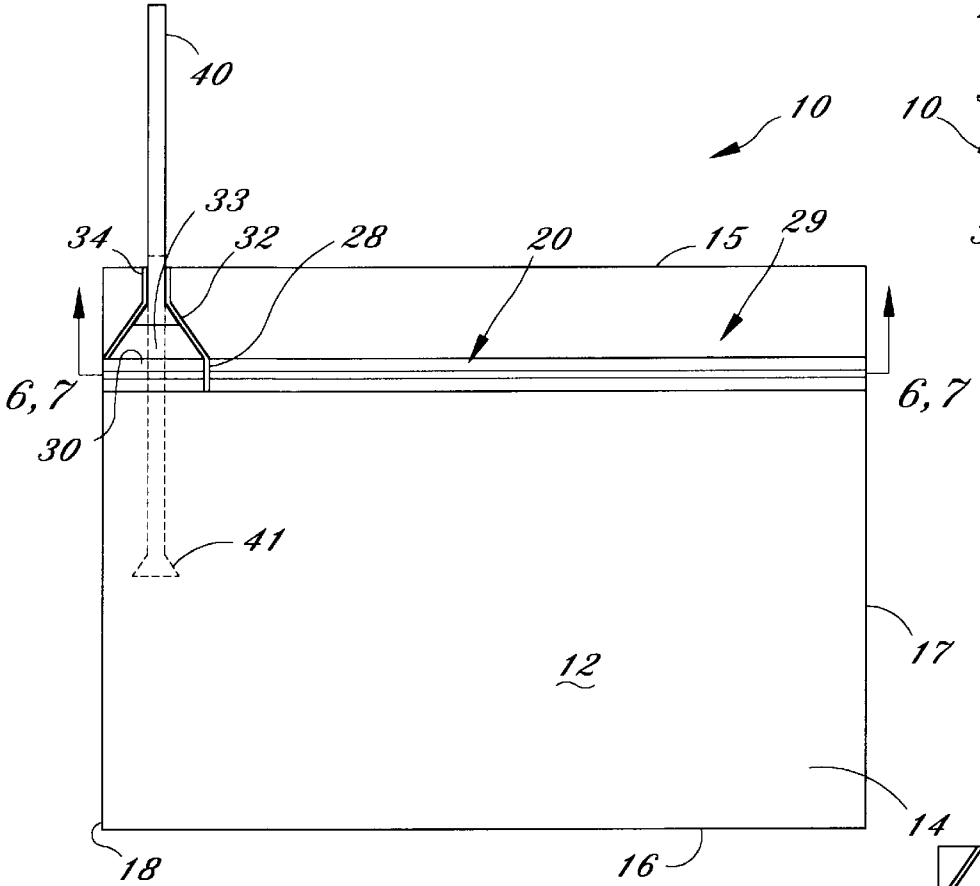
FIG. 1 is an elevational view of the preferred embodiment of the self-sealing, disposable storage bag of the instant invention.
Figure 6:
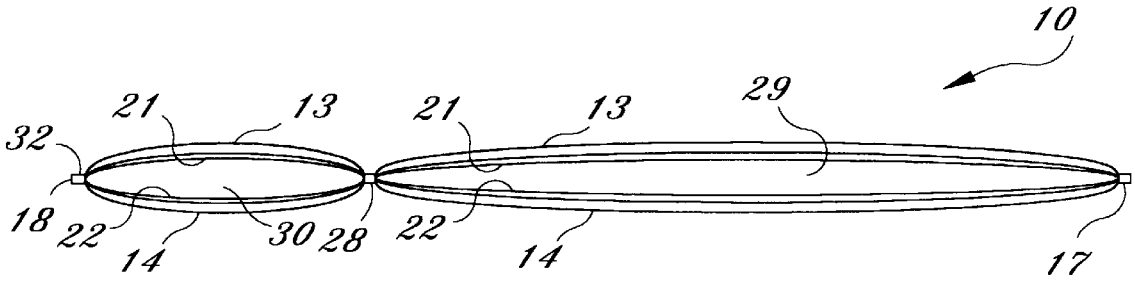
FIG. 6 is a cross-sectional, top view of the self-sealing, disposable storage bag of the instant invention, taken along lines 6—6 of FIG. 1, illustrating the evacuation opening and the main opening in the open positions.
Figure 7:
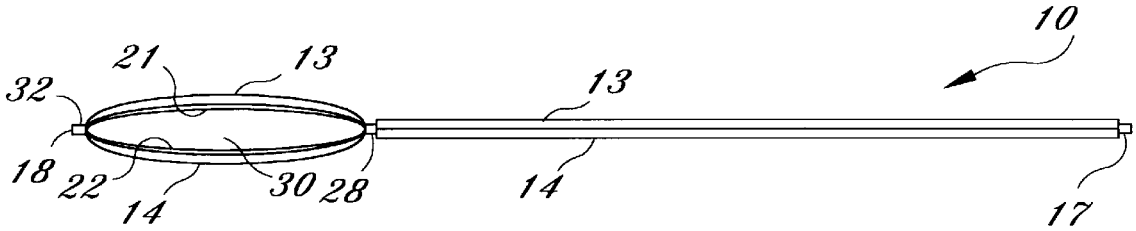
FIG. 7 is a cross-sectional, top view of the self-sealing, disposable storage bag of the instant invention, taken along lines 7—7 of FIG. 1, illustrating the main opening in the closed position and the evacuation opening in the open position.

With reference to the drawings, FIGS. 1–15 depict the various embodiments of the self-sealing, evacuable storage bag of the instant invention, which is generally referenced by the numeric character 10. Referring to FIG. 1, the self-sealing, evacuable storage bag 10 (hereinafter "storage bag 10") generally comprises a pouch 12 having a first panel 13, a second panel 14, a bottom end 16, a first side edge 17, a second side edge 18, an open, albeit sealable, top end 15, and a tongue and groove interlocking system 20 for releasably sealing the open end 15 closed. The open top end 15 mechanically communicates with interlocking system 20 to provide access to an inner volume 19. The first and second panels 17, 18, the bottom end 16, and the top end 15 define the inner volume 19 for placing items, such as food, perishables, or biohazardous waste. The instant invention is designed for use with foods and biohazardous waste as depicted by the several embodiments disclosed herein. When storing food and perishable items, the storage bag 10 is designed for evacuating air from the volume 19 up to a point of a vacuum, if necessary. This embodiment may also be designed to provide an airtight seal that keeps air from reentering the volume 19, keeping the items therein fresh. When storing biohazardous waste, the storage bag 10 is designed to keep air from escaping unintentionally.

With reference to FIGS. 1–7, the preferred embodiment of the storage bag 10 comprises the pouch 12, the tongue and groove interlocking system 20, a releasable, sealable main opening 29, and a releasably sealable evacuation opening or section 30. The evacuation opening 30 and main opening 29 are defined at the top end 15 by the interlocking system 20 and a strip barrier 28. The interlocking system 20 comprises a tongue strip 21 which interlocks with a groove strip 22. The tongue strip 21 and groove strip 22 extend longitudinally across the inner surface of the first and second panels 13, 14. The tongue and groove strips 21, 22 may extend to the side edges 17, 18 or short thereof, so long as the top end 15 may be completely closed. The strip barrier 28 comprises a heat-sealed barrier, but may also comprise a break in the strips or another substitutable barrier, to divide the interlocking system into two distinct sections. That is, the interlocking system 20 is not continuous from end to end in this embodiment. Thus, the evacuation opening 30 may be defined by one pair of tongue and groove strips, while the main opening 29 is defined by another pair of tongue and groove strips. However, to allow the storage bag 10 to be easily adapted for manufacturing by existing manufacturing techniques, the tongue and groove strips 21, 22 are preferably heat-sealed at a predetermined point that coincides with the desired size of the evacuation opening 30. Contents are placed in the volume 19 through the preferably wider main opening 29 which is subsequently shut by pressing the tongue strip 21 into the groove strip 22. To evacuate air from the volume 19, air is drawn through a suction conduit 40 which is in fluid communication with the volume 19 at one end, and an external suction source at the other end. The suction source may comprise human suction or some other external device such as that shown in FIG. 15. The suction conduit 40 may preexist in the evacuation opening or may be installed therein to communicate with the volume 19. Air may be suctioned out of the bag 10 orally or by an external device, such as a vacuum or a pump. Alternatively, air may be forced out through the evacuation opening 30 by applying pressure to the bag once the main opening 29 is closed.

In accordance with another aspect of the preferred embodiment, the storage bag 10 may include an evacuation opening 30 which is further defined by a tapered barrier 32. The tapered barrier 32 preferably comprises heat-sealed barriers which are formed by heat sealing the first and second panels 13, 14 together in the shape of the barrier directly above the evacuation opening 30. The tapered barrier 32 may comprise an integral extension of the strip barrier 28. The tapered barrier 32 may comprise various configurations, so long as it satisfies the objects of the instant invention. The various shapes of the strip barrier 28 and tapered barrier 32 are shown in FIGS. 1–5. The tapered barrier 32 may include a lower tapered section for receiving the flanged end of the conduit, a corridor 33 for passing the conduit, and an upper tapered section that allows a conduit removed to be fed back through the barrier 32 and into the bag 10.

Figure 2:
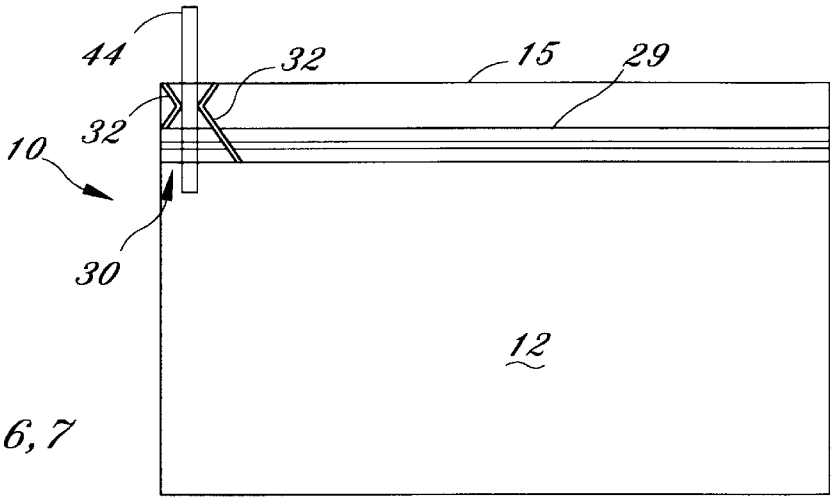
FIG. 2 is an elevational view of the self-sealing, disposable storage bag of the instant invention, illustrating the spacer device for holding the evacuation opening open.
Figure 5:
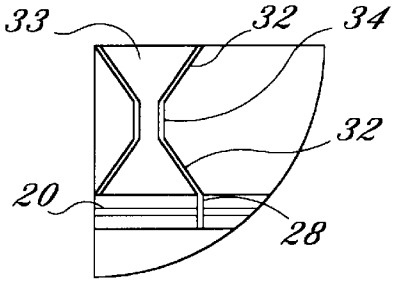
FIG. 5 is a partial elevational view of the tapered barrier and strip barrier of the self-sealing, disposable storage bag in accordance with the instant invention.
Figure 4:
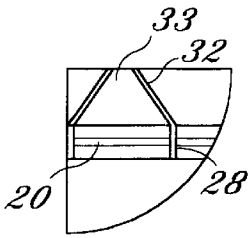
FIG. 4 is a partial elevational view of the tapered barrier and strip barrier of the self-sealing, disposable storage bag in accordance with the instant invention.
Figure 3:
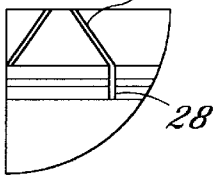
FIG. 3 is a partial elevational view of the tapered barrier and strip barrier of the self-sealing, disposable storage bag in accordance with the instant invention.

With reference to FIGS. 1 and 2, the tapered barrier 32 is designed to snugly receive the lower end of the suction conduit 40 or a strip spacer 44 and defines a corridor 33 to the evacuation opening 30. The suction conduit 40 may comprise a straw. The lower end 41 of the suction conduit 40 or straw preferably defines a tapered, flanged end 41 that mates with the angles of the tapered barrier 32 to send the flange end against the barrier 32 for the efficient evacuation of air from the bag 10. Prior to exhausting air from the volume 19, the suction conduit 40 is pulled upward until the flanged end 41 fully engages the tapered barrier 32. This allows the evacuation opening 30 to be immediately closed without obstructing the interlocking strips 21, 22 in the evacuation opening 30 once air has been evacuated. Alternatively, a strip or stick 44 may be placed in the evacuation opening 30 via the barrier 32 and corridor 33 to keep the opening 30 open as air is pressed or drawn from the bag 10. The strip spacer 44 or straw 40 may be pre-installed, or installed upon use.

Figure 14:
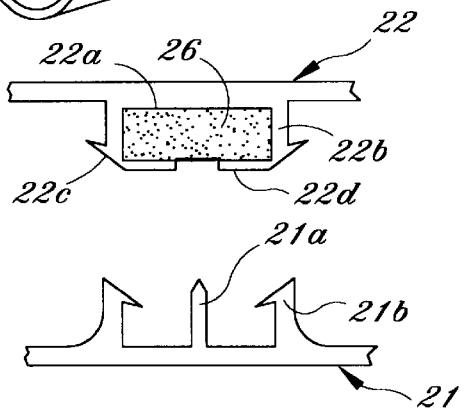
FIG. 14 is an elevational end view of a self-sealing, interlocking system which may be used in accordance with the instant invention.
Figure 9:
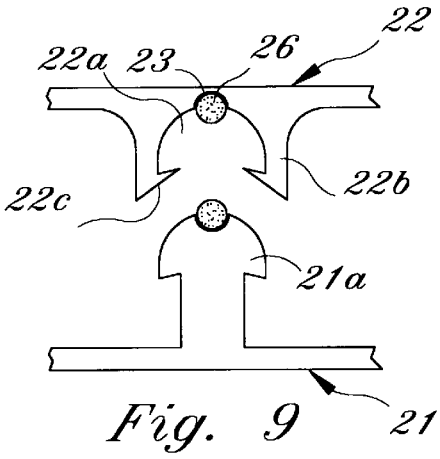
FIG. 9 is an elevational view of a self-sealing, interlocking system which may be used in accordance with the instant invention.
Figure 10:
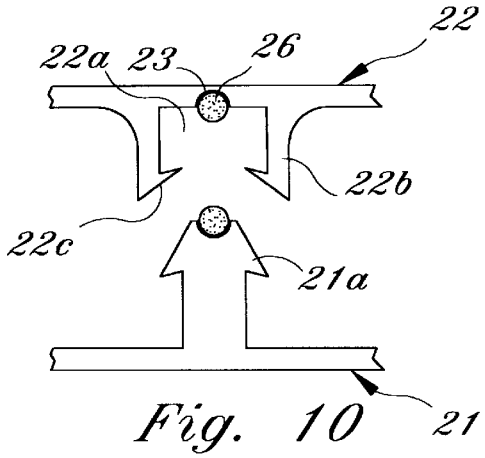
FIG. 10 is an elevational end view of a self-sealing, interlocking system which may be used in accordance with the instant invention.
Figure 13:
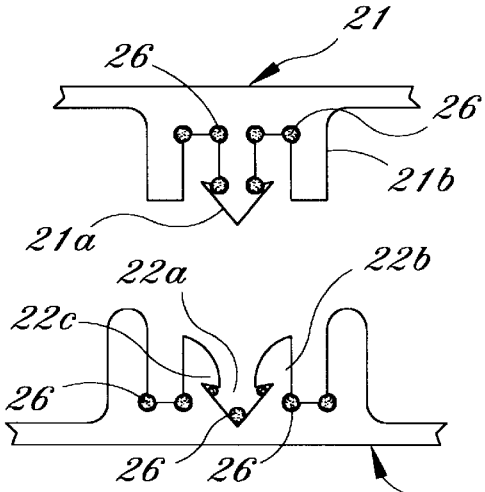
FIG. 13 is an elevational end view of a self-sealing, interlocking system which may be used in accordance with the instant invention.

The interlocking system 20 comprises a tongue strip 21 and a groove strip 22. The tongue strip 21 is designed to interlock with the groove strip 22. With reference to FIGS. 9–14, the tongue strip 21 and groove strip 22 may comprise various configurations that interlock together. The tongue strip 21 preferably includes a protruding male portion 21*a* which is bordered on each side at a spaced distance by a flange 21*b* which includes an inwardly facing lip portion 21*b*. The groove 22 is generally defined by a void 22*a* as defined by opposing flanges 22*b* which define outwardly extending lips 22*c*. The lips 22*c* interlock with lips 21*b*. The male protrusion 21*a* is inserted into the void 22*a*. The gasket 26 is pliable enough to conform to the male protrusion 21*a* when closing the bag 10. The shapes of the flanges 21*b* and 22*b* may vary without departing from the scope and spirit of the invention so long as they interlock. With reference to FIG. 13, an additional set of flanges 22*d* define a second void 22*e* on each side of the main flanges 22*b*. These voids 22*e*, as defined by flanges 22*d*, comprise a shape which snugly receives flanges 21*b*. With reference to FIG. 14, the male protrusion 21*a* protrudes 30–50% into the void 22*a*, which is filled with or contains the gasket 26. The void flanges 22*b* may include inwardly facing retention flanges 22*d* for assisting in retaining the gasket material in the void 22*a*.

In accordance with another aspect of the preferred embodiment, the tongue and groove interlocking system 20 includes at least one pliable gasket 26, such as a gum-type sealant or silicone-based sealant, positioned, installed, or adhered therein. The gasket 26 is preferably inserted, rolled, pressed, or adhered in a novel cavity 23 formed in the void 22*a* of the groove strip 22 as shown in FIGS. 8–12. The cavity 23 may be formed in other sections of either the groove strip 22 or in the tongue strip 21. More than one gasket 26 may also be employed. Prior to installation, the substance making up the gasket 26 is heated to a temperature that facilitates a fluid consistency for injecting or applying the gasket 26 into the interlocking system 20. A fluid consistency allows a gasket 26 to level out in the cavity 23, groove strip, or tongue strip prior to curing. The gasket 26 preferably comprises a material that does not fully harden, but results in a soft, pliable gasket 26. The gasket should also comprise a non-toxic material. The gasket 26 may comprise a gum-type sealant or a silicone sealant. Preferably, it comprises a vinylpolysiloxane substance, or suitable substitute. The vinylpolysiloxane has the following specifications: (1) ISO of 4823, 3 low consistency—light-bodied; (2) a dimensional change after 24 hours of less than 0.1 percent; (3) a compression set of less than 0.3 percent; (4) a maximum strain and compression of 6.5 percent; and (5) a recovery from deformation of more than 99.7 percent. The detailed reproduction should be less than 0.010 mm, with a linear shrink rate of 0.03 percent. The gasket material should also have a sure hardness of 1H, as required, or less than 30. The physical chemical characteristics of the gasket comprise a water solubility with a negligible specific gravity of 0.96 to 1.25, with no odor, and incompatibility to strong oxidants, such as hydrogen gas, $SiO_2$, $CO_2$, CO, and traces of incompletely burned hydrocarbons at combustion. The flash point for the preferred gasket material is more than 419° F. and 215° C. The auto-ignition temperature should be more than 752° F. and 400° C. There should be no cold temperature changes at 0° F.

The gasket 26 may be injected into the interlocking system 26 with a needle, probe, spray gun, or similar device, and allowed to cure to its desired consistency. It may also be pre-extruded and sized so that it may be laid into the cavity 23 or other segment of the interlocking system 20. The pre-extrusion process has the advantage of exactly determining the size of the gasket 26 before laying it into its corresponding void. The gasket 26, if injected, may include a catalyst that controls the curing time.

The storage bag 10 preferably comprises a polyethylene material or similar thin, plastic film. The panels 13, 14 of the storage bag 10 may have a consistency that is puncture-proof.

Figure 8:
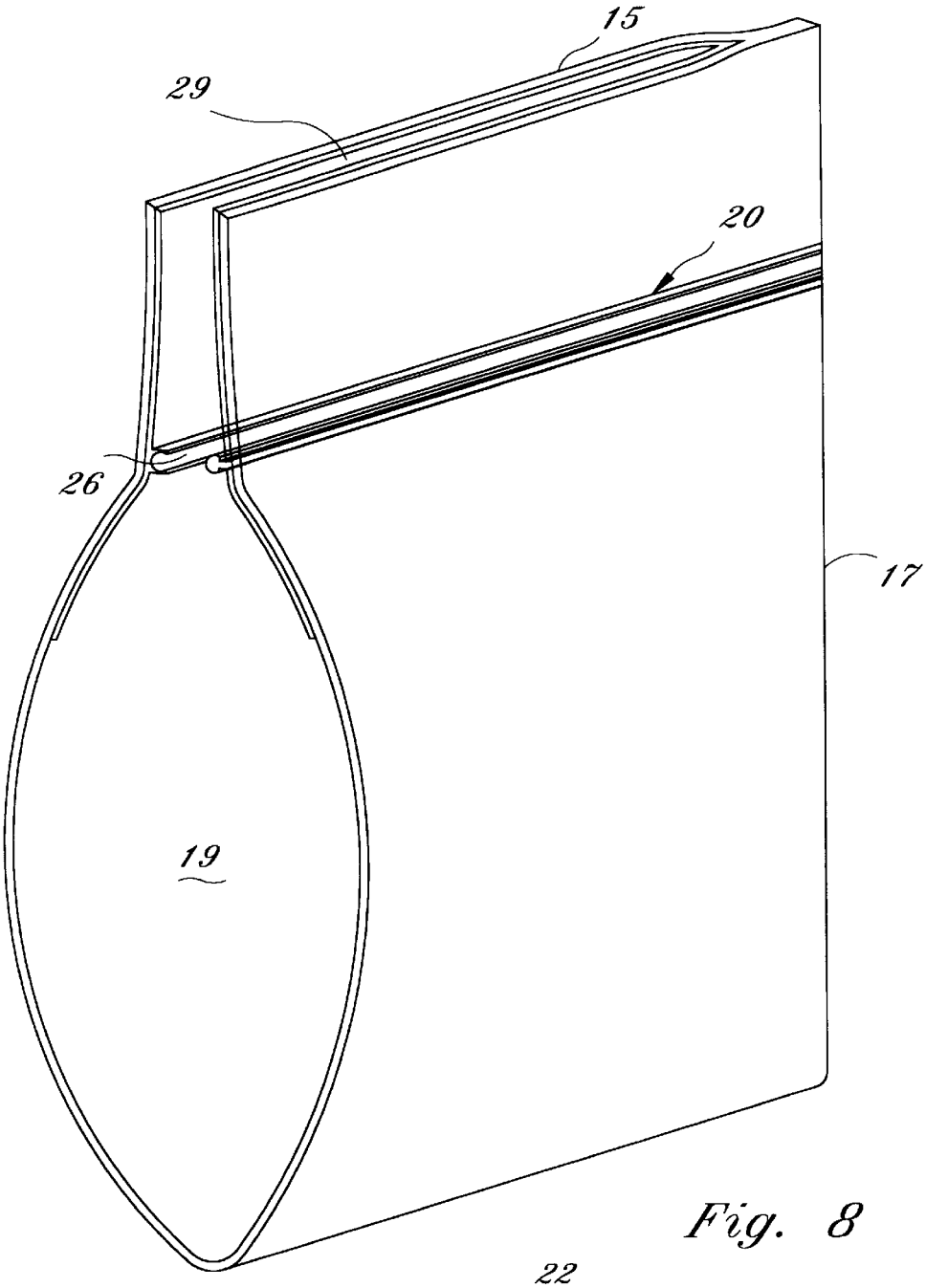
FIG. 8 is a cut away, perspective view of the self-sealing, disposable storage bag of the instant invention, illustrating the self-sealing, interlocking system and the gasket.

With reference to FIG. 8, another aspect of the preferred embodiment comprises a pouch 12 having at least one continuous self-sealing, interlocking strip pair 20 extending across the pouch 12 proximal the top end 15 and a gasket 26 in mechanical communication with the self-sealing strip system 20 for providing an airtight seal. As previously discussed, the self-sealing, continuous strip pair 20 includes a tongue strip 21 and a corresponding groove strip 22. The gasket 26 is preferably positioned and secured in a cavity 23, groove, or nook formed in either the groove strip 22 or tongue strip 21. The placement of the gasket 26 in the cavity 23, or similar structure, helps to secure the gasket 26. The gasket 26 may also be secured in the groove strip 22 or tongue strip 21, without a cavity, by an adhesive, interlocking structure, or some other structure known in the art. These additional securing means may also be used in conjunction with the cavity 23. The gasket 26 provides an airtight seal when the groove strip 22 and tongue strip 21 are engaged and interlocked. The airtight seal prevents air from entering or escaping the storage bag 10. Thus, this embodiment is ideal for storing biohazardous waste. This embodiment may also include a means for exhausting air from the bag 10, such as an evacuation opening 30 or valve, as disclosed herein. For non-biohazardous waste, the air may be exhausted into the ambient. For biohazardous waste, the air may be exhausted into an exterior purifying device, filter, incinerator, or other device known for capturing and purifying dangerous emissions. It should be noted that additional self-sealing securing strips 20–22 may be included with the storage bag 10 in parallel orientation to the first strips 20–22 or at other orientations.

In another embodiment, the storage bag 10 may include an adhesive seal along or near the top end 15, in addition to or in replacement of the self-sealing, interlocking system 20. This makes the storage bag 10 unopenable and disposable once sealed shut. This embodiment may also include any of the evacuation opening structures 30, as disclosed herein. The evacuation opening 30 may be incorporated exclusively with the adhesive seal or with the adhesive seal in interlocking system 20.

Figure 11A:
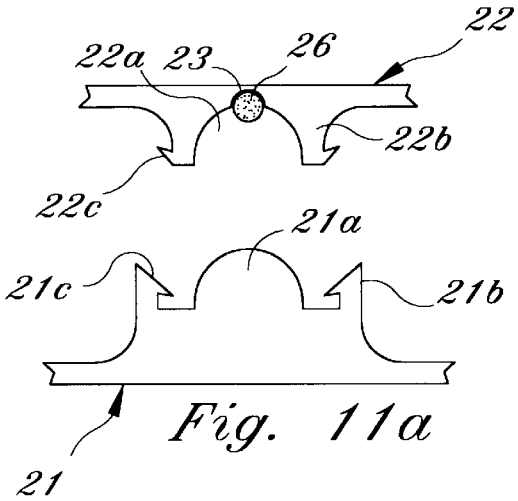
FIG. 11*a* is an elevational end view of a self-sealing, interlocking system which may be used in accordance with the instant invention.
Figure 11B:
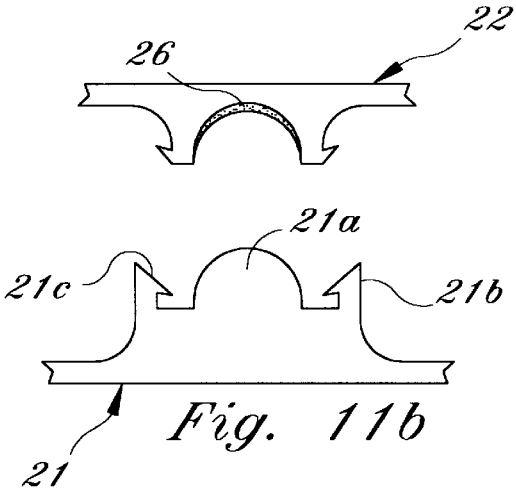
FIG. 11*b* is an elevational end view of a self-sealing, interlocking system which may be used in accordance with the instant invention, and illustrates a gasket applied with a spray gun.
Figure 12:
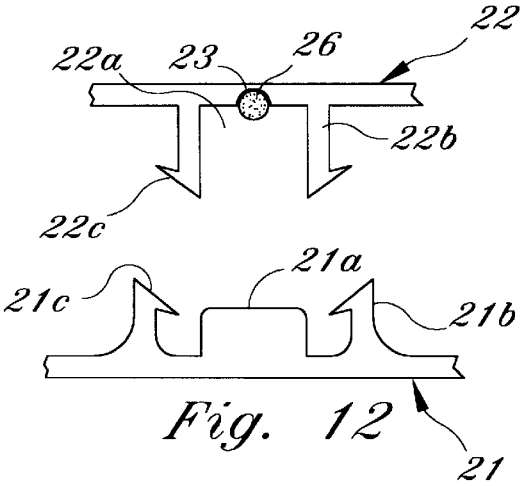
FIG. 12 is an elevational end view of a self-sealing, interlocking system which may be used in accordance with the instant invention.

The instant invention also comprises a novel manufacturing process that includes nonobvious steps which complement known manufacturing techniques. The storage bag is manufactured by extruding the storage bag 10 in an open position, such that the first and second panels 13, 14 are on substantially the same plane. The strips 21, 22 may be formed simultaneously when extruding the sheet. In the embodiments having a gasket 26, when extruding the strips 21, 22, the gasket 26 is injected, pressed, or laid into the desired strip 21, 22, which may or may not include a cavity 23. The cavity 23 is also formed by the mold, passage, or other structure. It should be noted that the cavity 23 may be formed in the groove strip 22, tongue strip 21, or both, depending on the location and number of gaskets 26. The tongue strip 21 and groove strip 22 may be extruded and heat-sealed, adhered to, or permanently affixed to the interior surface of the first and second panels 13, 14, respectively. The strips 21, 22 may also be formed and extruded together with the sheet comprising the bag. In the embodiments employing a gasket 26, the gasket is injected into the appropriate strip (21 and/or 22) in its liquid or fluid state by a needle, probe, spray gun, or equivalent substitute device. The spray gun would employ a catalyst to control the curing rate of the gasket material and would cover a larger area as shown in FIG. 11*b*. The gasket 26 must be in a state that allows it to spread as it cures into its final state. The gasket 26, in its final, cured state, comprises a soft, pliable sealant that changes form in accordance with the tongue and groove strips 21, 22 when they are engaged and interlocked together. Alternatively, the gasket 26 may be pre-extruded into the appropriate size or pre-extruded and then cut to size. The gasket 26 may be inserted into the appropriate strip (21 and/or 22) by a press, roller, or some other known device and procedure. In those embodiments employing an evacuation opening 30, the strip barrier 28 and tapered barrier 32 are formed, preferably by heat-sealing. In those embodiments having a suction conduit 40 or a spacer 44, the conduit 40 or spacer 44 may be positioned on one panel prior to folding the panels 13, 14 together. The conduit 40 or spacer 44 may also be inserted after the storage bag 10 is formed, before or after the tapered barrier 32 is formed. A spacer 44 may be used in lieu of a suction conduit 44 to keep the evacuation opening 30 open during the evacuation procedure. After all air has been exhausted, the spacer 44 is removed. The conduit or spacer 44 may comprise a stick, paper, or other device.

Figure 15:
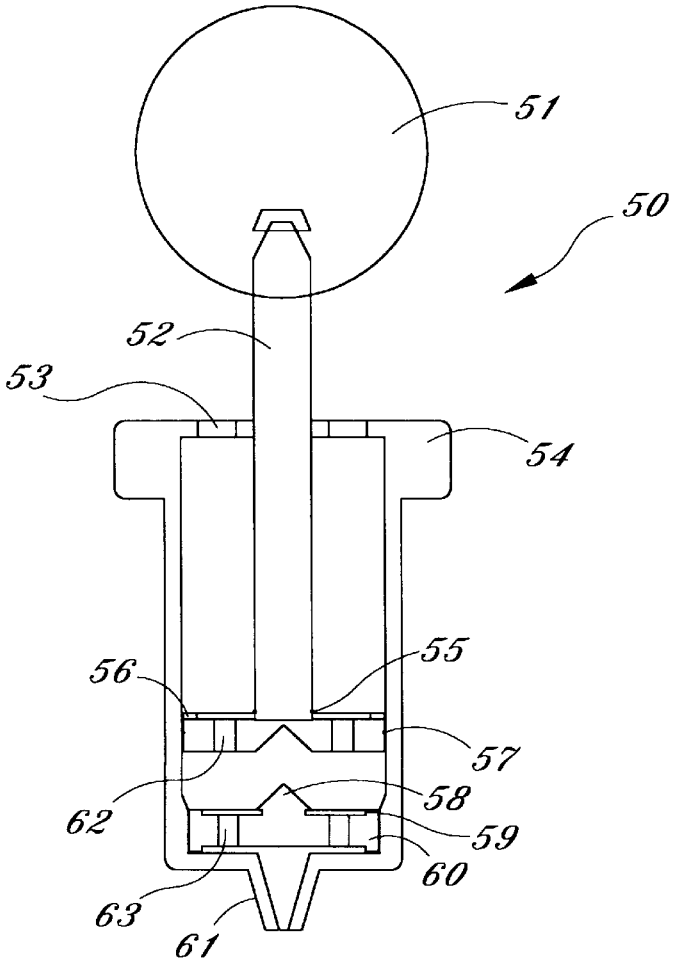
FIG. 15 is a cross-sectional view of an external evacuation device which may be used with the instant invention for removing air from the self-sealing, disposable storage bag.

Any of the embodiments disclosed herein may be used for storing perishables or biohazardous waste. When storing perishables, it is preferred that air be exhausted from the storage bag volume 19. When storing biohazardous waste, it may not be desired to exhaust the air unless there is some mechanism for storing and/or treating the contaminated air. When exhausting air from a storage bag 10 housing perishables, the air may be exhausted orally or by some other mechanism. Obviously, the oral evacuation of air from a bag storing biohazardous waste is discouraged. Any type of exterior mechanical device may be used for exhausting air. One such device is shown in FIG. 15. The mechanical device 50 shown in FIG. 15, comprises a snap-on ball handle 51, a piston 52, air holes 53, a snap-on top with air holes 54, an O-ring retainer for the rubber valve 55, a rubber valve 56, an O-ring seal 57, air holes 62 formed in the rubber valve 56, a built-in rubber valve retainer 58, a rubber valve 59, a press-in valve body 60, air holes 63 formed in the rubber valve 59, and a tapper to fit the storage bag 61. The ball handle 51 and piston 52 assembly is cycled to draw air from the storage bag 10.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A substantially airtight self sealing storage bag system, said bag system comprising:

a pouch with an accessible volume defined by a first panel and a second panel forming a closed bottom end, closed side edges and a top end, said top end comprising a first closable opening and a second closable opening, said first and second closable opening being adjacently disposed;

a barrier permanently joining a section of said first panel and said second panel above said second closeable opening, said barrier providing access to said second closeable opening for use in drawing air from said volume;

an interlocking system comprising a first interlocking strip on an interior surface of said first panel and a second interlocking strip on an interior surface of said second panel, said first and second interlocking strips being connectable together when said first and second interlocking strips are longitudinally aligned, engaged, and pressed together so as to close said open top end;

a dividing barrier permanently joining a section of said first interlocking strip and said second interlocking strip, said barrier dividing said interlocking system into two distinct, independent systems and defining said first closable opening and said second closable opening, said first closable opening providing access to said volume for placing contents, said second closable opening providing an evacuation port for exhausting air from said volume when said first closable opening is closed; and a removable spacer for selectively holding said second closeable opening open.

2. A storage bag system as recited in claim 1, further comprising:

a pliable gasket disposed in said first interlocking strip for providing a substantially airtight seal when said first and second interlocking strips are engaged.

3. A storage bag system as recited in claim 2, wherein said gasket comprises vinylpolysiloxane.

4. A storage bag system as recited in claim 1, wherein said second closeable opening is smaller than said first closable opening.

5. A storage bag system as recited in claim 1, wherein the tapered barrier has a lower taper facing down towards said second closeable opening and an upper taper facing up toward said top end.

6. A storage bag system as recited in claim 1, further comprising:

means for drawing air from said volume through said evacuation port.

7. A storage bag system as recited in claim 6, wherein said means for drawing air comprises a suction conduit.

8. A substantially airtight self sealing storage bag system, said bag system comprising:

a pouch with an accessible volume defined by a first panel and a second panel forming a closed bottom end, closed side edges and a top end, said top end comprising a first closable opening and a second closable opening, said first and second closable openings being adjacently disposed;

an interlocking system comprising a first interlocking strip on an interior surface of said first panel and a second interlocking strip on an interior surface of said second panel, said first and second interlocking strips extending continuously between said closed side edges and being connectable together when said first and second interlocking strips are longitudinally aligned, engaged, and pressed together so as to close said open top end;

a dividing barrier permanently joining a section of said first interlocking strip and said second interlocking strip, said barrier dividing said interlocking system into two distinct, contiguous systems and defining said first closable opening and said second closable opening, said first closable opening providing access to said volume for placing contents, said second closable opening providing an evacuation port for exhausting air from said volume when said first closable opening is closed;

a channel defined by said first interlocking strip and a pliable gasket completely disposed in said channel for providing a substantially airtight seal when said first and second interlocking strips are engaged; and a suction channel formed above and in fluid communication with said second closable opening by said first and second panels, and a suction conduit at least partially and sealingly disposed in said suction channel, and being removable therefrom, for drawing air from said volume through said second closable opening.

* * * * *